United States Patent [19]

Svoboda et al.

[11] Patent Number: 4,524,990

[45] Date of Patent: Jun. 25, 1985

[54] ADJUSTING MECHANISM

[75] Inventors: Josef Svoboda, Schwechat; Alois Himmetsberger, Vienna; Emilie Szabo, Schwechat, all of Austria

[73] Assignee: TMC Corporation, Baar, Switzerland

[21] Appl. No.: 320,631

[22] Filed: Nov. 12, 1981

[30] Foreign Application Priority Data

Nov. 14, 1980 [AT] Austria ..... 5624/80

[51] Int. Cl.[3] ..... A63C 9/22

[52] U.S. Cl. ..... 280/633

[58] Field of Search ..... 280/633, 617, 616, 618, 280/623, 636, 607, 611, 630

[56] References Cited

U.S. PATENT DOCUMENTS

| | | | |
|---|---|---|---|
| 2,740,972 | 4/1956 | Taylor | 280/617 |
| 3,314,687 | 4/1967 | Tiesler | 280/617 |
| 3,514,119 | 5/1970 | Sutherland | 280/617 |
| 3,830,510 | 8/1974 | Stauffer | 280/633 |
| 3,915,466 | 10/1975 | Matsuda | 280/617 |

FOREIGN PATENT DOCUMENTS

| | | | |
|---|---|---|---|
| 140878 | 3/1935 | Austria | 280/617 |
| 2363662 | 8/1974 | Fed. Rep. of Germany | 280/633 |
| 2832121 | 1/1980 | Fed. Rep. of Germany | 280/633 |
| 1454509 | 8/1966 | France | 280/623 |

*Primary Examiner*—David M. Mitchell

*Attorney, Agent, or Firm*—Flynn, Thiel, Boutell & Tanis

[57] ABSTRACT

An adjusting mechanism for a jaw of a ski binding. The adjusting mechanism includes a holding plate which is fixedly secured to the upper surface of a ski. A base plate for the ski binding component is slidably disposed on the holding plate with locking means being provided to lock the base plate to the holding plate. That is, structure is provided for preventing the base plate from lifting off from the holding plate and locking structure is provided to prevent relative longitudinal movement therebetween.

13 Claims, 17 Drawing Figures

ADJUSTING MECHANISM

FIELD OF THE INVENTION

The invention relates to an adjusting mechanism for a jaw of a ski binding, in particular for a front jaw, which mechanism has a holding plate which can be fixed to the upper side of a ski and having several pairs of receiving openings extending in the direction of the longitudinal axis of the ski and symmetrically in relationship to the aforesaid axis, and, further, a base plate on which the jaw is mounted and which also has receiving openings therein, wherein the base plate can be locked to the holding plate by means of pin bolts, fixing screws or the like.

BACKGROUND OF THE INVENTION

Such an adjusting mechanism is described for example in U.S. Pat. No. 3,248,124. In this conventional embodiment, the ski-fixed plate is constructed as a guide rail having extensions which extend on both sides to the outside, onto which extensions can be moved the base plate with the jaw thereon and can be fixed thereto by means of two fixing screws, which have their guideways in the base plate. This is disadvantageous because the fixing screws rest with their threaded parts on the wall of the receiving openings and can suffer a deformation due to loads applied thereto, which then results in an unsafe holding of the base plate and thus also in an unsafe holding of the jaw. Furthermore an intermediate plate is movably guided and lockable to the ski-fixed holding plate, wherein the base plate which carries the jaw is also locked on the aforesaid intermediate plate. The intermediate plate itself has furthermore a number of openings therein which are aligned in a longitudinal direction of the ski. A further base plate with a different jaw, namely a rear jaw, can be moved onto the intermediate plate in a similar manner as already described and can be locked by means of a pin bolt on the intermediate plate. This conventional unitary design has, therefore, the disadvantage that, aside from a holding plate which is secured to the upper side of the ski, an additional structural part, namely the intermediate plate, is necessary. In addition, the entire adjusting mechanism, in relationship to the longitudinal axis of the ski, is relatively long in its construction which can result in incorrect releases when the skis bend, since the ski shoe between the two jaws forms a type of chord in relationship to the bent ski section. A still further disadvantage consists in an adjusting of the jaw being possible only to the degree of the divisions between the receiving openings, which divisions must be greater than the diameter of the fixing screws to be inserted therein in order to provide a sufficient fastening between the individual receiving openings.

An adjusting mechanism is known from Austrian Pat. No. 292,526, wherein a serrated slat is provided which is connected to a ski-fixed slide rail. The serrated slat cooperates with a tooth system on the jaw and at least one further serrated slat is provided and is arranged above the serrated slat of the jaw and is movable in the slide rail with respect to the serrated slat. The two serrated slats are movable in the slide rail against the force of at least one spring. With this structure, a finer adjustment is to be assured than is possible through the divisions between the teeth on the serrated slat. However, this design has the usual disadvantage of serrated slats. That is, the tooth systems of serrated slats are sensitive with respect to icing up and do not provide a secure holding of the skier due to wear. This is particularly the case with front jaws, which must assure an adequate support preventing a forward movement. Less critical is the positioning of a rear jaw, due to the provision of a thrust balance thereon which, during skiing, has a preselected amount of play in the direction of the longitudinal axis of the ski.

Similar mechanisms are described in French Pat. No. 1 528 053 and No. 1 307 982, which, however, do not go beyond the already considered state of the art and are only mentioned here in order to be complete.

Swiss Pat. No. 212 583 describes an adjusting mechanism, in which receiving openings are provided extending in the direction of the longitudinal axis of the ski in a ski-fixed holding plate, into which openings a flexible pin can be selectively inserted to cause the position of a slide member serving as a support piece between the heel of the shoe and the ski to be fixed. However, with this conventional mechanism it is only possible to change the position of the slide member to the degree of the divisions between the receiving openings in the ski-fixed holding plate.

The invention has the purpose of providing an adjusting mechanism of the above-mentioned type which is simpler in construction and, with respect to the adjusting capabilities, more precise, namely, by having smaller divisions than is permitted by the diameter of the individual pin bolts, fixing screws or the like. If fixing screws are used to determine the position of the base plate, then the adjusting mechanism is also insensitive to wear of the threaded parts on the fixing screws, in order to assure also, after a longer use of the adjusting mechanism, a secure holding of the same. The adjusting mechanism is furthermore short in length in order to facilitate a bending of the ski without undesired side effects.

The set purpose is inventively attained by providing in the base plate of the jaw for receiving the pin bolts, fixing screws or the like, at least two pairs of openings which are constructed as countersunk holes, the divisions between which, viewed in a direction perpendicular to the longitudinal axis of the ski, is offset in the holding plate with reference to the divisions between the receiving openings, and by the guideway for the base plate being provided in the central longitudinal range of the holding plate.

The inventive measure facilitates a movement of the jaw with its base plate on the upper side of the ski-fixed holding plate into the respectively desired position with a fine division, namely with intermediate values of the divisions in the holding plate, and to directly fix it in this position by means of the pin bolts, fixing screws or the like.

One preferable embodiment of the invention is in the provision of divisions between the openings in the base plate of the jaw which are 1.1 to 1.9, preferably 1.5, times the divisions between the receiving openings in the holding plate. From this results a division which is particularly preferable for use and also assures a sufficient fastening of both plates. The division between the receiving openings is thereby sensibly designed such that it corresponds to the desired position for various skiing situations.

According to a preferred embodiment of the invention, the guideway on the holding plate is constructed as a dovetail guide, into which a dovetail designed counterpart constructed on or secured by means of rivets to the undersigned of the base plate is received. In this manner, a particularly secure holding of the jaw to the ski is assured.

A further development of this concept of the invention consists in the dovetail counterpart, viewed in the direction of movement into the dovetail guide, being constructed of a wedgelike form. In this manner, the guiding function is made easier, however, the fixing of the base plate relative to the holding plate is fully assured.

A further concept of the invention consists in the receiving openings for the fixing screws for the base plate of the jaw being designed as threaded holes and being constructed directly in the ski-fixed holding plate. Since the threaded holes are provided in the holding plate, an undesired deformation of the same due to wear cannot occur; the base plate and thus also the jaw always assume a defined position relative to the ski.

It is furthermore preferable if as fixing screws conventional fillister-head screws having flat threads are used.

Another concept of the invention consists in the two pin bolts being fastened to a leaf spring, which in turn is held by means of a rivet in a slotted hole in the base plate and is adjustable in the direction of the longitudinal axis of the ski, however, is not liftable from the base plate. Through this inventive measure, it is possible for the two pin bolts to become disengaged by lifting the two side regions of the spring plate from their position of engagement with the holding plate, so that the base plate can be adjusted relative to the holding plate in the direction of the longitudinal axis of the ski. If a position is desired corresponding with a division between the divisions on the holding plate, then it is possible to adjust the spring plate in the slotted hole of the base plate in the direction of the longitudinal axis of the ski and it is possible to place the two pin bolts through the other pair of receiving openings in the base plate to become engaged with the holding plate.

According to a different concept of the invention the two fixing screws are each held in an auxiliary plate by means of a spring clip type of washer and corresponding recesses or countersunk holes for receiving the individual washers are provided in the base plate. The two fixing screws can in this embodiment of the invention be shifted easily by means of the auxiliary plate from one position in the base plate into the other position.

A still further concept of the invention consists in providing as fixing elements bolts having at least one shoulder, preferably two shoulders thereon. The bolts can be inserted into the receiving openings of the base plate. The openings are constructed as a type of a slide lock or bayonet type of lock. The region of the bolt extending into the holding plate is biased in a direction toward the base plate by a track in the receiving opening of the holding plate or by an elastic element, wherein for locking of the bolt in its position, a slot, a cross slot or the like is provided at the head area of said bolt. A type of a slide lock is created in this manner, which slide lock permits an engagement or disengagement in a simple manner by a rotating of the bolt.

Each receiving opening is preferably provided in the holding plate with a receiving slot for the two shoulders of the bolt, which receiving point is designed as a cross (or an X). A locking of the base plate relative to the holding plate can occur through this inventive measure such that the bolt in the receiving opening of the holding plate is first pressed down, then is rotated 90° by means of the slot provided in the head region of the bolt, then is released. The bolt with the two shoulders is moved upwardly through the further recesses of the receiving opening of the holding plate by the earlier mentioned (inner) control track or by the elastic element in a direction toward the base plate, so that the head region of the bolt terminates with the upper side of the base plate. In this manner, on the one hand, a secure holding of the base plate relative to the holding plate to prevent an unintended movement in the direction of the longitudinal axis of the ski is achieved and, on the other hand, a simple releasable locking arrangement is provided.

An advantageous further development of the invention consists in the control track, which is provided inside of the receiving opening and which extends from the slot-like recesses to facilitate an insertion of the bolt into the recesses, having a rising inclination. This also assures through a small, elastic element a final locking position of the bolt in the receiving opening. Another further development of the concept of the invention consists in the elastic element which loads the bolt being a spring cushion which consists of a rubber material, preferably of a foam rubber. This development of the elastic material is preferable for weight and installation considerations. The use of such a foam rubber spring is thereby also preferable for reasons of expense.

A still further characteristic of the invention is in each of the openings being constructed in the base plate as a threaded hole, wherein in all threaded holes in the base plate there is arranged a setscrew or a headless screw. The length of each setscrew corresponds with the thickness (height) of the base plate. By using two pairs of setscrews or headless screws, a locking of the base plate with respect to the holding plate is achieved. This embodiment has the advantage that the setwcrews or screw pins which serve to lock the parts together are always in place whereby, however, it must be accepted that due to this construction, snow, ice or the like can accumulate in the receiving openings of the locked setscrews or screw pins.

A further development of this concept of the invention includes the provision of structure to prevent the last-mentioned disadvantage that a blocking piece or cover, preferably of a plastic material, is arranged with a forced fit in the base plate above the locking setscrews or headless screws. Such blocking pieces or covers are known per se from the furniture industry; they are to be inserted into openings which are used for the selective arrangement for example of boards used as shelves or also to close off openings, including countersunk openings with screws therein, for beautification purposes. Such elements have slotted shanks, which shanks, but for the neck area, have a slightly larger diameter than the receiving openings. This creates after the insertion of said blocking pieces a spring force in the area of the shanks of said structural parts, which creates the forced fit. The removal of such blocking pieces or covers can be accomplished in the dry condition by the use of finger nails, in the iced-up condition by a simple tool, for example a pocket knife or a screw driver. Since such blocking pieces or covers are inexpensive as mass produced articles, their replacement in the case of a possible loss is unimportant. They influence the correct functioning of the inventive locking mechanism only insofar as they prevent a plugging up or icing up of the upper areas of the receiving openings in the base plate.

A still further development of the invention can be seen in the receiving openings in the holding and/or in the base plate, as this is actually known, being designed as partly intersecting one another. This development of the receiving openings has the advantage that the divisions therebetween can become yet finer without creating the disadvantage which exists in toothed locking systems.

BRIEF DESCRIPTION OF THE DRAWINGS

Further characteristics, advantages and details of the invention will now be described in greater detail with reference to the drawings illustrating six exemplary embodiments.

In the drawings:

FIGS. 1 to 3 illustrate an adjusting mechanism embodying the invention and having a front jaw, wherein FIG. 1 is a side view, FIG. 2 is a front view and FIG. 3 is a top view;

FIGS. 4 and 5 illustrate the holding plate without the base plate and the jaw, wherein FIG. 4 is a top view and FIG. 5 is a cross-sectional view taken along the line V—V of FIG. 4;

FIGS. 6 to 7 are a second exemplary embodiment, wherein FIGS. 6 and 7 are each a cross-sectional view taken along the line VI—VI of FIG. 8.

FIGS. 9, 9*a* and 10 illustrate a third exemplary embodiment, wherein FIG. 9 is a cross-sectional view taken along the line IX—IX of FIG. 10, FIG. 10 is a top view of FIG. 9 and FIG. 9*a* is an enlarged detail of FIG. 9;

FIGS. 11 to 13 illustrate a fourth exemplary embodiment of a locking arrangement utilizing a type of a slide lock or bayonet type of lock, wherein FIG. 11 and FIG. 12 are associated central cross-sectional and top, respectively, views and FIG. 13 is an enlarged perspective illustration thereof;

FIGS. 14 and 15 illustrate a fifth exemplary embodiment, wherein FIG. 14 is a longitudinal cross-sectional view of the locking arrangement taken along the line XIV—XIV of FIG. 15 and FIG. 15 is a cross-sectional view taken along the line XV—XV of FIG. 14.

DETAILED DESCRIPTION

Figure 1:
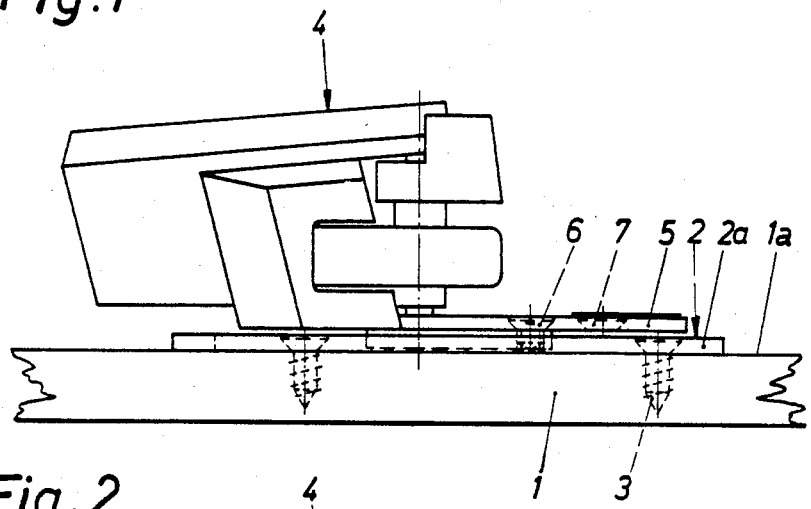
Figure 2:
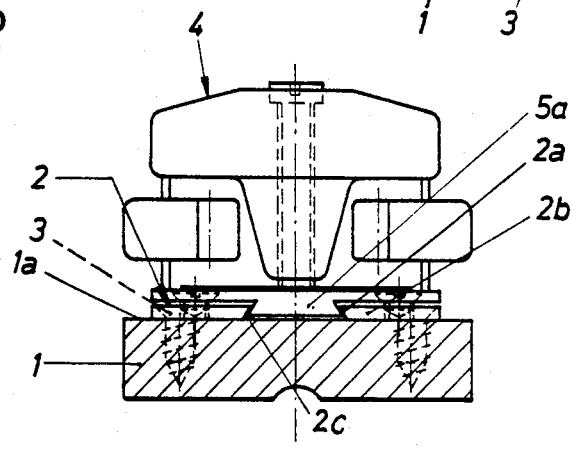
Figure 3:
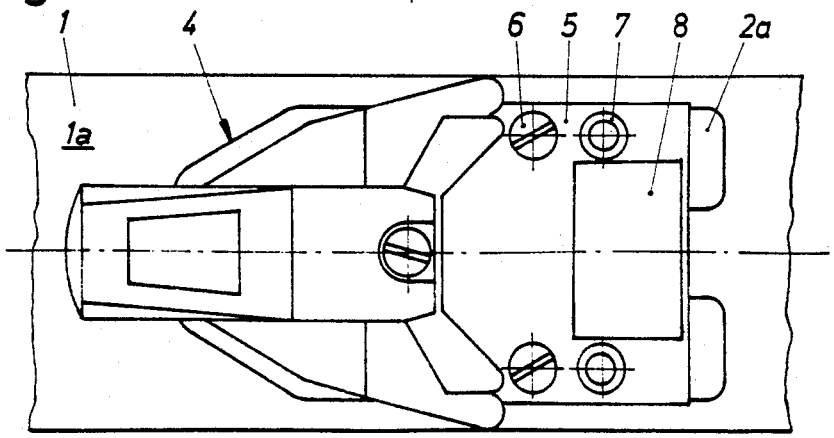
Figure 5:
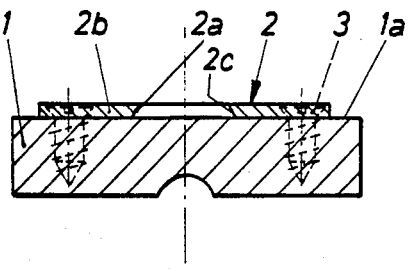
Figure 4:
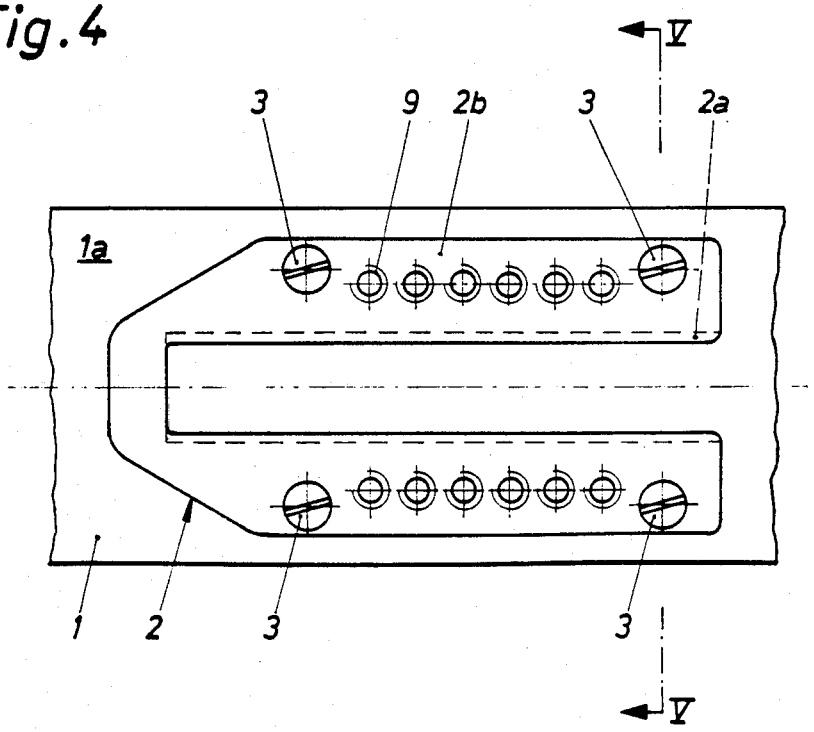

In the first exemplary embodiment according to FIGS. 1 to 5, there is provided a flat, uniformly thick and generally U-shaped holding plate 2 having generally parallel legs 2*b* oriented to extend parallel to the longitudinal axis of the ski as shown in FIG. 4. Each of the legs 2*b* has plural openings 9 therethrough, which openings are oriented in a line extending parallel to the longitudinal axis of the ski. Each of the plural openings is internally threaded. The holding plate 2 is secured to the upper surface 1*a* of the ski by a plurality of screws received in appropriate openings in the holding plate and in the ski, preferably in the legs 2*b* of the holding plate. The inwardly facing edges 2*a* of the legs 2*b* are inclined from the top outwardly to define a dovetail recess 2*c*.

A base plate 5 is provided having a ski binding component, here a toe jaw, mounted thereon. The base plate has a dovetail projection 5*a* on the underside thereof slidingly receivable in the recess 2*c*. The interfit between the dovetail parts will prevent a lifting of the base plate 5 from the holding plate 2. The base plate 5 has a pair of laterally spaced openings 7 on each side of the longitudinal center line of the toe jaw. The openings 7 are also countersunk at the top thereof to facilitate the reception of flat head screws therein and cause the heads thereof to be flush with the upper surface of the base plate.

To position the front jaw 4 in different positions relative to the holding plate 2, the holding plate has the two aforemetioned rows of threaded holes 9 therein, which in relationship to the longitudinal axis of the ski 1, are arranged on the two legs 26 thereof. The division between the threaded holes 9 permits an adjustment of the front jaw 4 by means of the base plate 5 through a certain distance relative to the holding plate 2. To design this division if necessary yet finer, the division between the openings 7 in the base plate is offset or different from the division between the threaded holes 9, so that through the selective insertion of the fixing screws 6 into one of the pairs of openings 7, an intermediate value in the position of the front jaw 4, in relationship to the longitudinal axis of the ski and holding plate 2, can be achieved.

The dovetailed counterpart 5*a* can either be manufactured as a separate structural part or, as in the present example, be integral with the material of the base plate 5. If the dovetailed counterpart 5*a* is secured to the underside of the base plate 5, it can be done so, for example, by means of rivets. The base plate 5 carries on its upper surface a conventional slide plate 8, which serves to reduce the frictional forces during a release operation. The slide plate 8 is not part of the subject matter of the invention; it was only illustrated to show that a common slide mechanism can also be used in association with the present inventive device.

Figure 6:
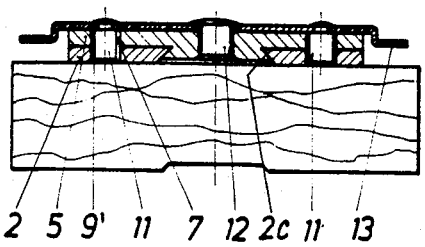
Figure 7:
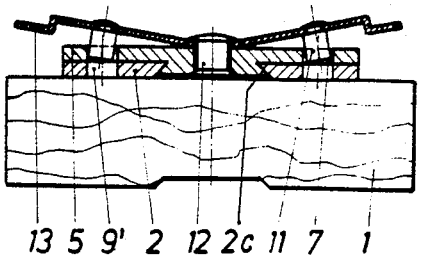
Figure 8:
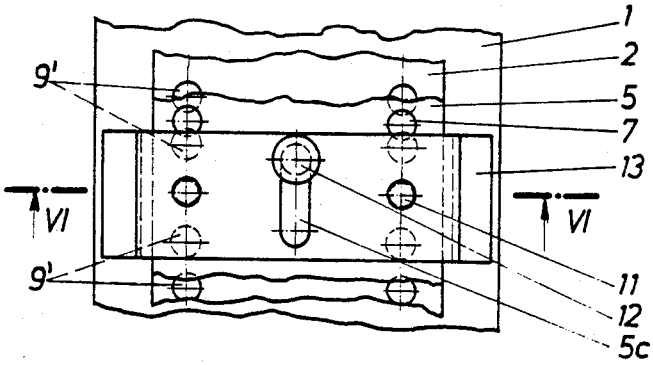
FIG. 8 is a top view of FIGS. 6 and 7.

In the second exemplary embodiment according to FIGS. 6 to 8, pins 11 are provided on a leaf spring 13 adjustably secured to the base plate 6. The pins 11 extend through laterally spaced openings 7 in the base plate 5 and are received in receiving openings 9' of the holding plate 2 to lock the base plate 5 to the holding plate 2. The leaf spring 13 is held to the base plate 5 by means of a rivet 12 received in a centrally located slotted hole 5*c* in the base plate 5 to prevent same from lifting off, however, is guided adjustably for movement in the direction of the longitudinal axis of the ski. Thus it is possible to place the two pins 11 selectively through one of the pairs of openings 7 in the base plate 5 and then to cause same to lock also selectively with a pair of the receiving openings 9' of the holding plate 2. This too facilitates a finer or closer division between the openings 9' than would exist in the case of the division or spacing between the receiving openings 9 in the holding plate 2 of FIGS. 1 to 5.

Figure 9:
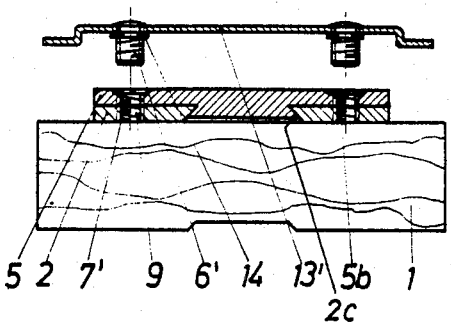
Figure 9A:
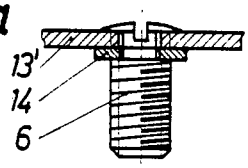
Figure 10:
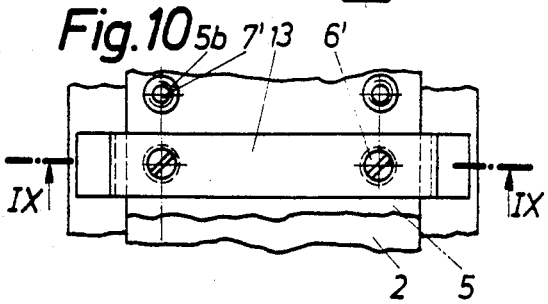

In a further exemplary embodiment according to FIGS. 9, 9*a* and 10, fixing screws 6' are each permanently but rotatably held on an auxiliary plate 13' by means of a spring clip type of washer 14. The fixing screws 6' extend through threaded holes 7' in the base plate 5 and are received in threaded holes 9 in the holding plate 2. Furthermore each countersinking 5*b* in the threaded holes 7' receives the washer 14 therein in a shifted condition thereof. FIG. 9*a* shows thereby a fixing screw 6' with the associated washer 14 and a portion of the auxiliary plate 13' in an enlarged scale.

Figure 11:
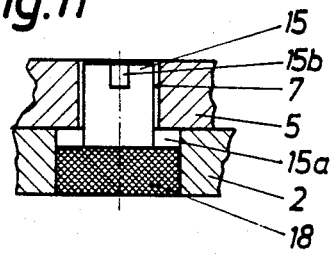
Figure 12:
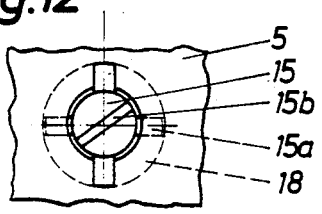
Figure 13:
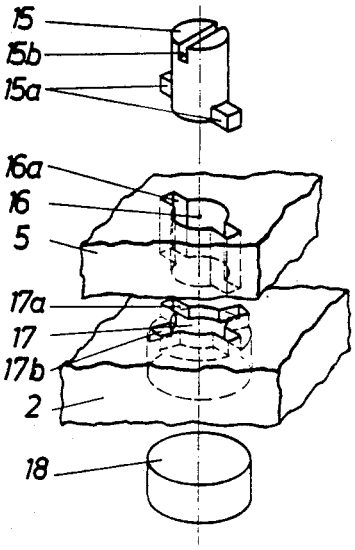

In the embodiment according to FIGS. 11 to 13, a type of slide lock is provided for locking the base plate 5 to the holding plate 2. A bolt 15 has two shoulders 15*a* and on its head portion a slot 15*b* for receiving a flat bladed tool therein, such as a screw driver. FIG. 11 illustrates the base plate 5 and the holding plate 2 held together by means of the bolt 15 in a locked position thereof, wherein the underside of the bolt 15 is biased upwardly by a spring cushion 18 made preferably of foam rubber. The head area of the bolt 15 terminates flush with the upper surface of the base plate 5, so that snow, ice or the like will not penetrate into the receiving opening 7 in the base plate 5.

For a better understanding of the aforementioned structure, the slide lock is illustrated in FIG. 13 in an enlarged perspective illustration. The base plate 5 has an opening 16 therein with bayonet type slots 16*a* receiving the bolt 15 and the two shoulders 15*a* therethrough. The holding plate 2 has an opening 17 therein with bayonet type slots 17*a*, 17*b* therein and constructed in the form of a cross (or X). The opening 17 is enlarged in the bottom to form an undercut region and is adapted to receive the spring cushion 18 therein. After the bolt 15 has been inserted into the bayonet type slot 16*a* of the base plate 5 and same has been moved into the desired position with the holding plate 2, the bolt 15 is pressed against the force of the spring cushion 18 downwardly in the direction of the upper side of the ski 1, then the bolt 15 is rotated by means of a suitable tool, for example by means of a screw driver to its locking position, here at 90°, so that the two shoulders 15*a* of the bolt 15 will lie under the undercut offset from the bayonet type slots 17*b* of the opening 17, which recesses are offset in this embodiment at 90°, as can be taken from FIG. 12. With this construction, the base plate 5 is fixed relative to the holding plate 2 in the direction of the longitudinal axis of the ski 1, and a lifting up of the base plate 5 from the holding plate 2 is prevented.

By suitably designing the bayonet type slot 17*a*, the use of a stronger elastic element can also be avoided. In this case the extent of the control surface from the recess of the bayonet type slot 17*a* to the insertion of the bolt 15 in the direction of the locked position thereof is designed with a slope, so that by rotating the bolt 15 this structural part automatically travels into a snugly locked position relative to the inserted position. With this construction, the flush relationship between the head region of the bolt 15 and the upper surface of the base plate 5 is also assured. A weak elastic element will provide the necessary support for the bolt 15.

Figure 14:
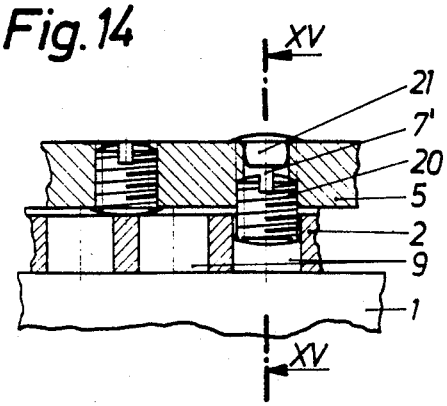
Figure 15:
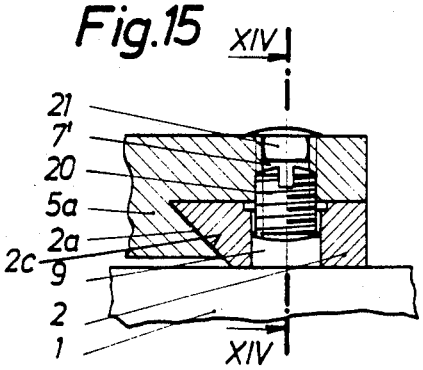

In the fifth exemplary embodiment according to FIGS. 14 and 15, the receiving openings in the base plate 5 are designed each as a threaded hole 7', in each of which a setscrew or screw pin 20 is received. The setscrew or the screw pin 20 is screwed into the threaded holes 7', which are in alignment with the receiving opening 9 in the holding plate 2, so that the setscrew or the screw pin 20 is screwed approximately halfway into the holding plate 2 and halfway into the base plate 5. This provides a locked condition of the base plate 5 relative to the holding plate 2, wherein in the other threaded hole 7' (or threaded hole pair) the individual setscrews or screw pins 20 lie only in the base plate 5. Additionally to prevent a lifting up of the base plate 5 from the holding plate 2, a dovetail guide 2*a* with a dovetail counterpart 5*a* is provided (compare FIG. 15).

As one will further recognize from FIGS. 14 and 15, a blocking piece or cover 21 is inserted into each threaded hole 7', which cover 21 is forced fit into the threaded hole 7'. This is due to the fact that the shank of the cover 21 is slightly thicker than the diameter of the threaded hole 7' and the cover 21 itself is slit open in its shank area.

Figure 16:
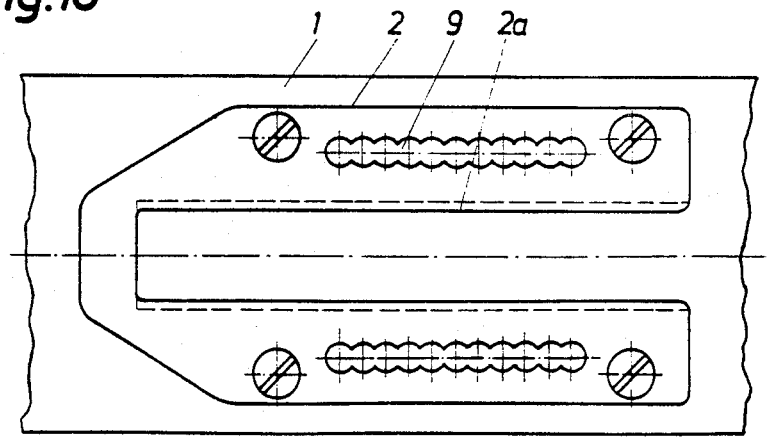
FIG. 16 is a top view of a holding plate having receiving openings therein.

Receiving openings 9'' in the holding plate 2'' are provided in the sixth exemplary embodiment according to FIG. 16, which receiving openings 9'' are constructed partially intersecting one another. Thus, between the individual, side-by-side receiving openings 9'' logically a smaller division is achieved that can be achieved for example in the embodiment according to FIG. 4. In this manner the number of possibilities of adjustment is increased, which can yet be refined further by providing the base plate with intermediate divisions. This refined division is independent of whether we deal with receiving openings or receiving threaded holes in the holding and/or base plate.

The invention is not to be limited to the illustrated exemplary embodiments. Various modifications are conceivable without departing from the scope of the invention. For example, it was already pointed out that the division between the receiving openings in the holding or base plate can be refined in various way. Also the mechanisms which are provided to prevent a lifting of the base plate off from the holding plate can be exchanged among one another in relationship to the various types of the locking arrangements, for example a dovetail guide can be exchanged for a spring-groove guide or the like or vice versa.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. An adjusting mechanism for a jaw of a ski binding, comprising: a uniformly thick holding plate adapted to be fixed to an upper side of said ski, said holding plate being generally U-shaped and flat with an upwardly facing surface parallel to said upper side of said ski and having a pair of parallel legs with several pairs of laterally spaced first receiving openings therein and arranged in the direction of the longitudinal axis of the ski symmetrically in relationship to said axis, one of said pair of first receiving openings being provided in each leg and several of said receiving openings in each leg being equidistantly spaced from said longitudinal axis of said ski, a base plate on which is mounted said jaw, said base plate having at least two pairs of second receiving openings therein, the division between said second receiving openings in said base plate being offset in relationship to the division between said first receiving openings in said holding plate, means defining a dovetail guideway on the inside edges of each of said legs, a dovetail counterpart centrally disposed on said base plate slidingly received in said dovetail guideway, cooperating surfaces on said dovetail guideway and said dovetail counterpart preventing a separation of said counterpart from said guideway in a direction perpendicularly upward relative to said upper side of said ski, and pin means secured to said base plate and received in an aligned pair of said first and second receiving openings to hold said holding plate fixed to said base plate.

2. The adjusting mechanism according to claim 1, wherein the division between said receiving openings in said base plate is in the range of 1.1 to 1.9 times the division between said receiving openings in said holding plate.

3. The adjusting mechanism according to claim 2, wherein said division between said receiving openings in said base plate is 1.5 times the division between said receiving openings in said holding plate.

4. The adjusting mechanism according to claim 1, wherein said pin means are fixing screws and wherein said second receiving openings for said fixing screws are threaded holes.

5. The adjusting mechanism according to claim 4, wherein as fixing screws fillister-head screws with a flat thread are used.

6. The adjusting mechanism according to claim 1, wherein said pin means includes two pins secured to a leaf spring, which leaf spring in turn is adjustably held by means of a rivet in a slotted hole on said base plate.

7. The adjusting mechanism according to claim 1, wherein said pin means includes two fixing screws held on an auxiliary plate by means of a washer means, and wherein corresponding recesses for receiving the individual washers therein are provided in said base plate.

8. The adjusting mechanism according to claim 1, wherein said pin means includes bolts with at least one shoulder, thereon, said shoulder being insertable into said second receiving openings in said base plate and under an undercut on said holding plate to form a type of slide lock, and wherein the end of the bolt extending into said second receiving opening being biased in a direction toward said base plate by an elastic element, wherein for facilitating a locking of the bolts into a locked position, there is provided at a head end thereof a slot means to facilitate a rotative movement of said shoulder under said undercut.

9. The adjusting mechianism according to claim 8, wherein each first receiving opening is provided with four diametrically opposed slots defining an X.

10. The adjusting mechanism according to claim 8 or 9, wherein said elastic element which biases said bolt is a spring cushion which consists of a rubber material.

11. The adjusting mechanism according to claim 1, wherein each of said second receiving openings in said base plate is constructed as a threaded hole, wherein a setscrew or a headless screw is arranged in all threaded holes of said base plate, the length of which corresponds approximately with the thickness (height) of said base plate, and wherein in the locked position of said base plate relative to said holding plate, a pair of setscrews or headless screws engage said holding plate.

12. The adjusting mechanism according to claim 13, wherein a blocking piece of plastic material is arranged with a forced fit in said base plate above said setscrews or headless screws engaging said holding plate.

13. The adjusting mechanism according to claim 1, wherein said first receiving openings in said holding plate partially intersect one another.

* * * * *

UNITED STATES PATENT AND TRADEMARK OFFICE

CERTIFICATE OF CORRECTION

PATENT NO. : 4 524 990

DATED : June 25, 1985

INVENTOR(S) : Josef Svoboda, Alois Himmetsberger and Emilie Szabo

It is certified that error appears in the above-identified patent and that said Letters Patent is hereby corrected as shown below:

Column 10, line 21; change "13" to ---11---.

Signed and Sealed this

*Nineteenth* Day of *November 1985*

[SEAL]

*Attest:*

DONALD J. QUIGG

*Attesting Officer*

*Commissioner of Patents and Trademarks*